US007905800B2

(12) United States Patent
Oneschuk

(10) Patent No.: US 7,905,800 B2
(45) Date of Patent: Mar. 15, 2011

(54) HOCKEY SHOOTING TRAINING DEVICE

(76) Inventor: Darrin Oneschuk, Okotoks (CA)

( * ) Notice: Subject to any disclaimer, the term of this patent is extended or adjusted under 35 U.S.C. 154(b) by 143 days.

(21) Appl. No.: 12/340,096

(22) Filed: Dec. 19, 2008

(65) Prior Publication Data

US 2010/0160092 A1 Jun. 24, 2010

(51) Int. Cl.
*A63B 69/00* (2006.01)
*A63B 59/12* (2006.01)

(52) U.S. Cl. ..... 473/446; 473/422

(58) Field of Classification Search ..... 473/446, 473/422, 426, 423, 445, 471, 476, 477; 273/348, 273/371
See application file for complete search history.

(56) References Cited

U.S. PATENT DOCUMENTS

| | | | | |
|---|---|---|---|---|
| 3,955,815 | A * | 5/1976 | Deschesnes | 473/446 |
| 4,070,017 | A | 1/1978 | Lombardi | |
| 4,607,842 | A * | 8/1986 | Daoust | 473/446 |
| 5,161,799 | A * | 11/1992 | Nandra | 473/446 |
| 5,465,958 | A * | 11/1995 | Brun | 473/446 |
| 5,509,652 | A * | 4/1996 | Woronets | 473/446 |
| 6,099,420 | A * | 8/2000 | Nandra | 473/446 |
| 6,569,041 | B1 * | 5/2003 | Riivald | 473/446 |
| 6,638,186 | B2 * | 10/2003 | Williams | 473/446 |
| 7,104,901 | B1 * | 9/2006 | Mason | 473/446 |

FOREIGN PATENT DOCUMENTS

| | | | |
|---|---|---|---|
| CA | 1000755 | | 11/1976 |
| CA | 1221119 | | 4/1987 |
| CA | 1305731 | C * | 7/1992 |
| CA | 2086130 | | 6/1993 |
| CA | 2089926 | | 8/1993 |
| CA | 2160746 | | 7/1996 |
| CA | 2207207 | A * | 12/1998 |
| CA | 2308875 | | 11/2000 |

* cited by examiner

*Primary Examiner* — Mitra Aryanpour
(74) *Attorney, Agent, or Firm* — ADE & Company Inc.; Ryan W. Dupuis; Kyle R. Satterthwaite

(57) ABSTRACT

A hockey shooting training device comprises an elongate track and a carriage having a puck shaped an engaging member supported thereon for engagement by a hockey stick to be displaced along the track with the carriage from a starting end to a target end. Wheels on the carriage have a resilient peripheral surface for rolling along the track. A tether coupled to the carriage is wound onto a spool at the starting end of the track. Constant frictional resistance is applied to the spool during displacement of the carriage towards the target end as the tether unwinds from the spool. A winding mechanism on the spool returns the carriage to the starting end. An illuminated indicator extends along the track to provide visual guidance of the path of the carriage. A further indicator may indicate an angular offset of the engaging member from a central position about an upright axis.

19 Claims, 7 Drawing Sheets

HOCKEY SHOOTING TRAINING DEVICE

FIELD OF THE INVENTION

The present invention relates to a device for training and practicing shooting a hockey puck, and more particularly relates to a hockey shooting training device comprising an elongate track and an engaging member, for example a hockey puck, which is supported for sliding movement along the track.

BACKGROUND

Various attempts have been made to provide practice and training devices for various skills in the game of hockey. Various examples of such devices can be found in the following documents: U.S. Pat. No. 4,070,0178 by Lombardi; U.S. Pat. No. 6,099,420 by Nandra; U.S. Pat. No. 4,607,842 by Daoust; U.S. Pat. No. 7,104,901 by Mason; U.S. Pat. No. 5,465,958; U.S. Pat. No. 5,509,652 by Woronets; U.S. Pat. No. 6,569,041 by Riivald; U.S. Pat. No. 5,161,799 by Nandra; Canadian patent 1,000,755 by Lombardi; Canadian patent application 2,308,875 by Carrier et al.; Canadian patent application 2,086,130 by Walker et al.; Canadian patent 2,160,746 by Brun; Canadian patent application 2,089,926 by Nandra; Canadian patent 1,305,731 by Maki and Canadian patent 1,221,119 by Smith.

Among prior art devices, Canadian application 2,207,207 by Fiskari et al., U.S. Pat. No. 3,955,815 by Deschesnes and U.S. Pat. No. 6,638,186 by Williams disclose hockey shooting training devices in which the user performs a shooting action with a hockey stick against an adjustable resistance. The resistance in each instance comprises an elastic member which provides an increasing force of resistance with increasing displacement through the shooting action by the player. The continuously varying resistance results in a situation where it is very difficult for a user to maintain a proper technique throughout the shooting action. Furthermore the device provides limited interaction with the user in each instance to further limit the training experience.

SUMMARY OF THE INVENTION

According to one aspect of the invention there is provided a hockey shooting training device comprising:

an elongate track extending from a starting end to a target end;

a carriage supported on the track for sliding movement in a forward direction along the track between a start position adjacent the starting end and an end position adjacent the target end;

an engaging member coupled to the carriage for sliding movement therewith along the track, the engaging member extending upwardly above the track so as to be arranged to be engaged by a hockey stick of a user;

a spool supported for rotation about a spool axis which is fixed relative to the track;

a non-elastic tether having a first end wound onto the spool about the spool axis and a second end coupled to the carriage such that the tether is arranged to be unwound from the spool as the carriage is displaced from the start position to the end position;

a resistance mechanism arranged to apply a constant frictional force to the spool which controllably resists rotation of the spool and unwinding of the tether from the spool as the carriage is displaced from the start position to the end position; and a winding mechanism independent of the resistance mechanism and arranged to wind the tether onto the spool and return the carriage from the end position to the start position.

By providing a non-elastic tether wound onto a spool with a mechanism which applies a constant frictional force to the spool, a suitable training device results which provides a constant resistance to a shooting action by a user throughout the full range of motion of the shooting action to ensure a more proper technique is followed by the user during practice. The constant friction also permits a greater amount of resistance to be applied at the starting portion of the stroke as compared to the continuously varying elastic resistance provided in the prior art.

By further providing a suitable indicator which spans the length of the track and which is illuminated, feedback is provided to the user through their peripheral vision to further ensure that the user executes a proper technique while training. Additional features of an angular orientation indicator and an interactive control including various user prompts maximises the training experience for the user in a manner which is considerably improved over the prior art related devices.

According to a second aspect of the present invention there is provided a hockey shooting training device comprising:

an elongate track extending from a starting end to a target end;

a carriage supported on the track for sliding movement in a forward direction along the track between a start position adjacent the starting end and an end position adjacent the target end;

an engaging member coupled to the carriage for sliding movement therewith along the track, the engaging member extending upwardly above the track so as to be arranged to be engaged by a hockey stick of a user;

a resistance mechanism arranged to apply a resistive force which controllably resists displacement of the carriage from the start position to the end position; and an elongate indicator extending along the track in the forward direction, the indicator being arranged to be illuminated.

According to a third aspect of the present invention there is provided a hockey shooting training device comprising:

an elongate track extending in a forward direction from a starting end to a target end, the track comprising a channel having a bottom wall and a top wall which are spaced apart from one another along a length of the track and a slot in the top wall extending the forward direction along the length of the track;

a carriage supported in the channel of the track for sliding movement in the forward direction along the track between a start position adjacent the starting end and an end position adjacent the target end, the carriage comprising a plurality of wheels spaced apart in the forward direction adjacent opposing ends of the carriage and spaced apart in a lateral direction on opposing sides of the slot so as to be arranged for rolling movement along the channel of the track;

the wheels having a peripheral surface arranged for rolling movement along the channel of the track which comprises a resilient material;

an engaging member centrally coupled to the carriage between the wheels which are spaced apart in the forward direction and in the lateral direction for sliding movement with the carriage along the track, the engaging member extending upwardly through the slot in the top wall of the track to an upper end above the track so as to be arranged to be engaged by a hockey stick of a user; and a resistance mechanism arranged to apply a resistive force which controllably resists displacement of the carriage from the start position to the end position.

According to a further aspect of the present invention there is provided a hockey shooting training device comprising:

an elongate track extending from a starting end to a target end;

a carriage supported on the track for sliding movement in a forward direction along the track between a start position adjacent the starting end and an end position adjacent the target end;

an engaging member coupled to the carriage for sliding movement therewith along the track, the engaging member extending upwardly above the track so as to be arranged to be engaged by a hockey stick of a user;

the engaging member being coupled to the carriage for rotation relative to the carriage about an upright axis in two opposing directions from a central position to a respective pair of angularly offset positions;

a biasing mechanism arranged to bias the engaging member from both of the angularly offset positions to the central position;

an indicator arranged to indicate an angular offset of the engaging member from the central position about the upright axis; and a resistance mechanism arranged to apply a resistive force which controllably resists displacement of the carriage from the start position to the end position.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
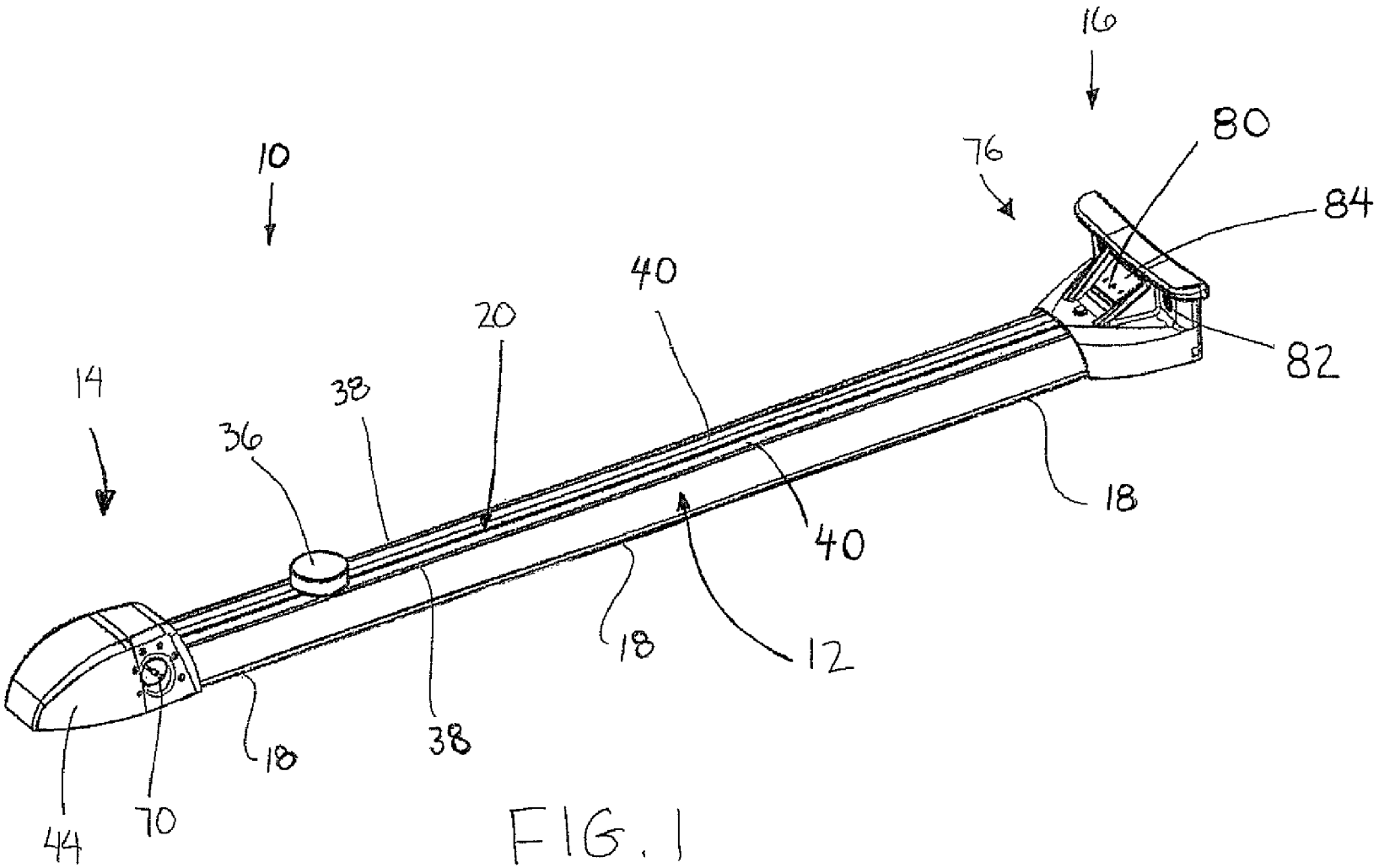
FIG. 1 is a perspective view of the hockey shooting training device.
Figure 2:
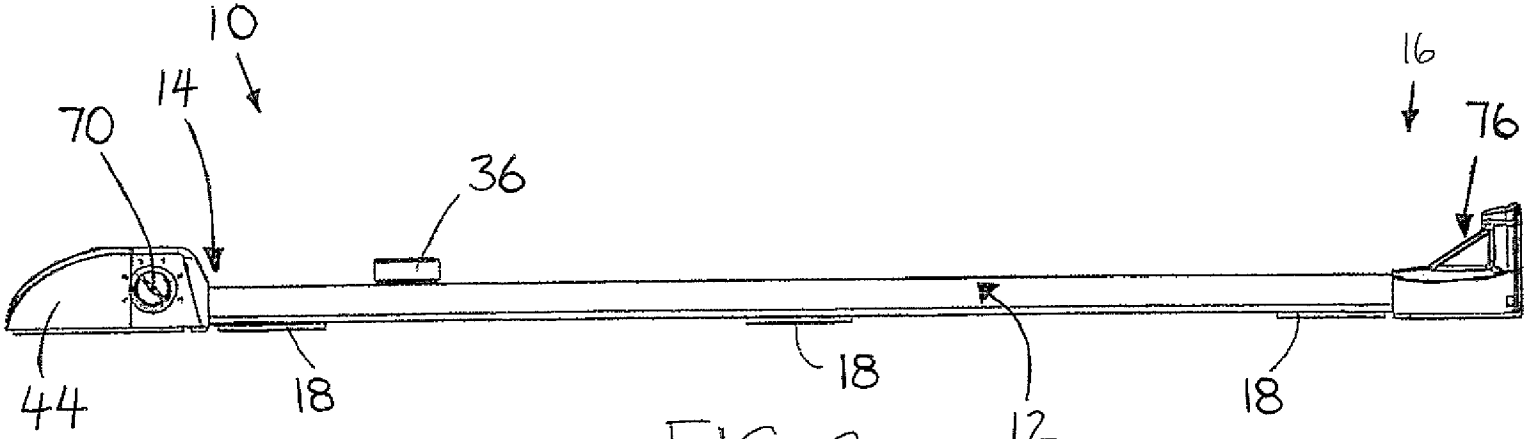
FIG. 2 and FIG. 3 are side elevational and top plan views respectively of the device according to FIG. 1.
Figure 3:
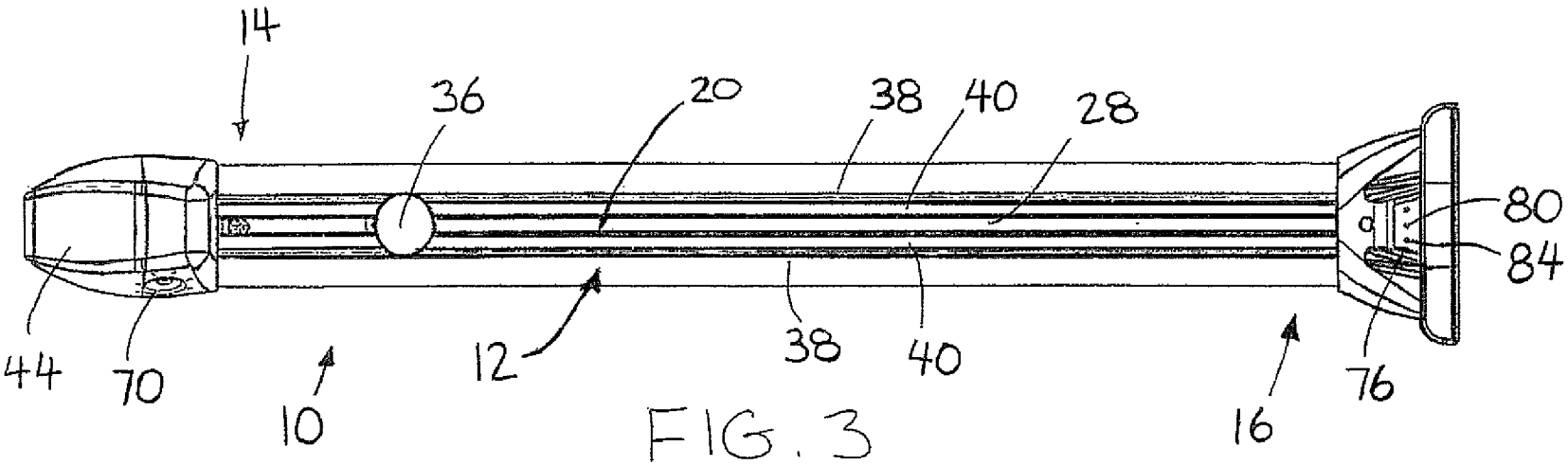
Figure 4:
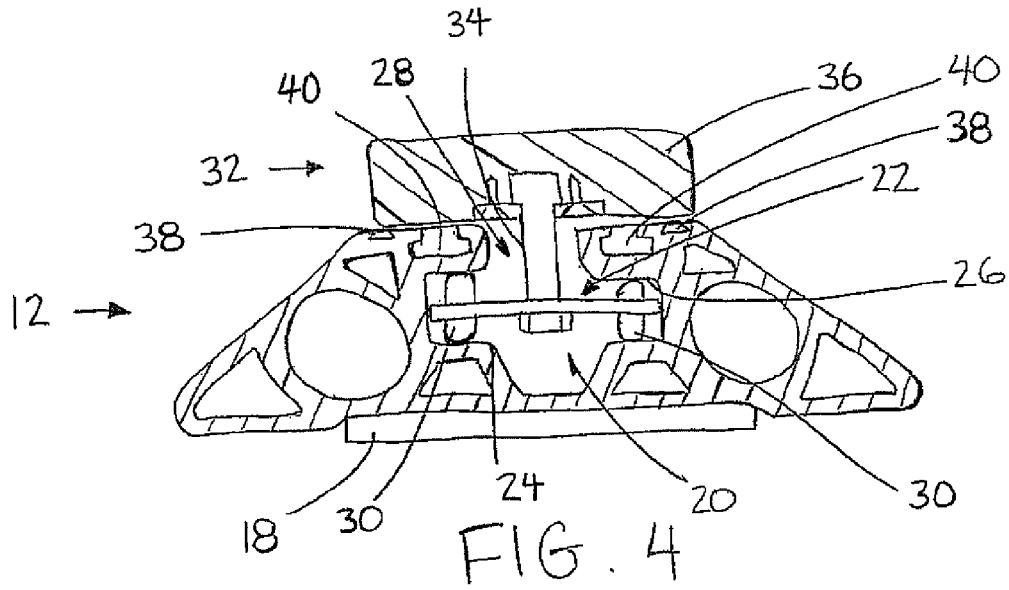
FIG. 4 is a sectional end view of the track of the device.
Figure 5:
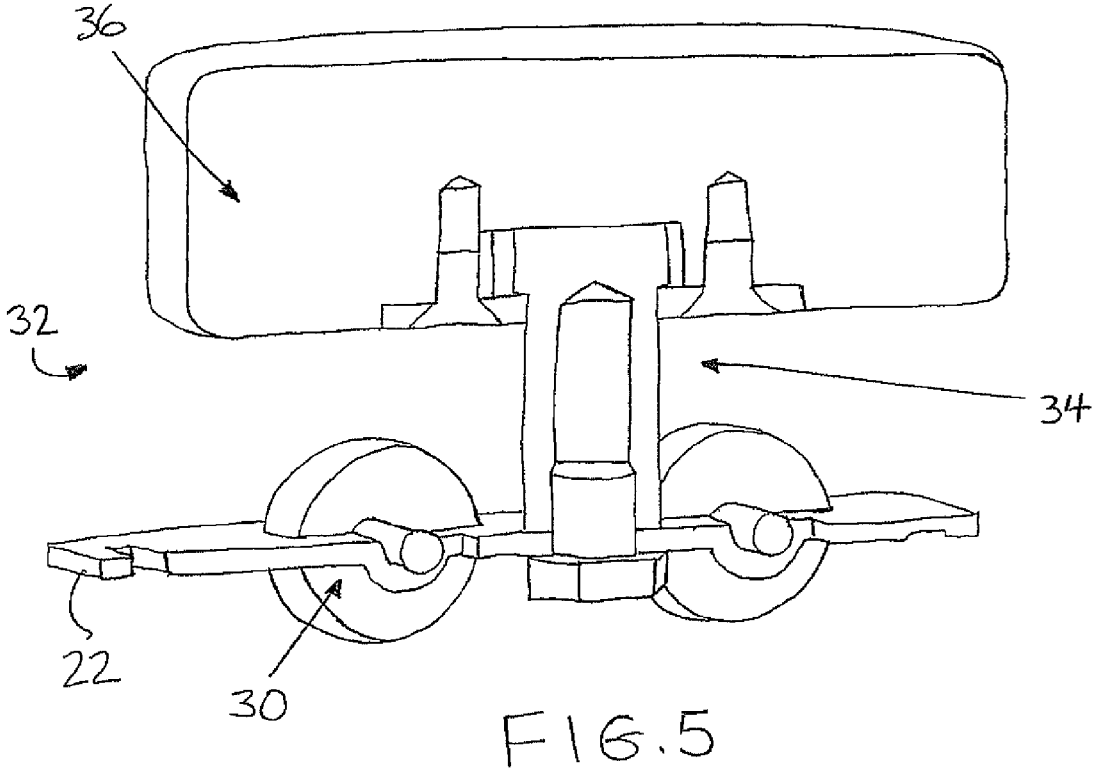
FIG. 5 is a perspective view of the engaging member supported on the carriage shown in cross section.
Figure 6:
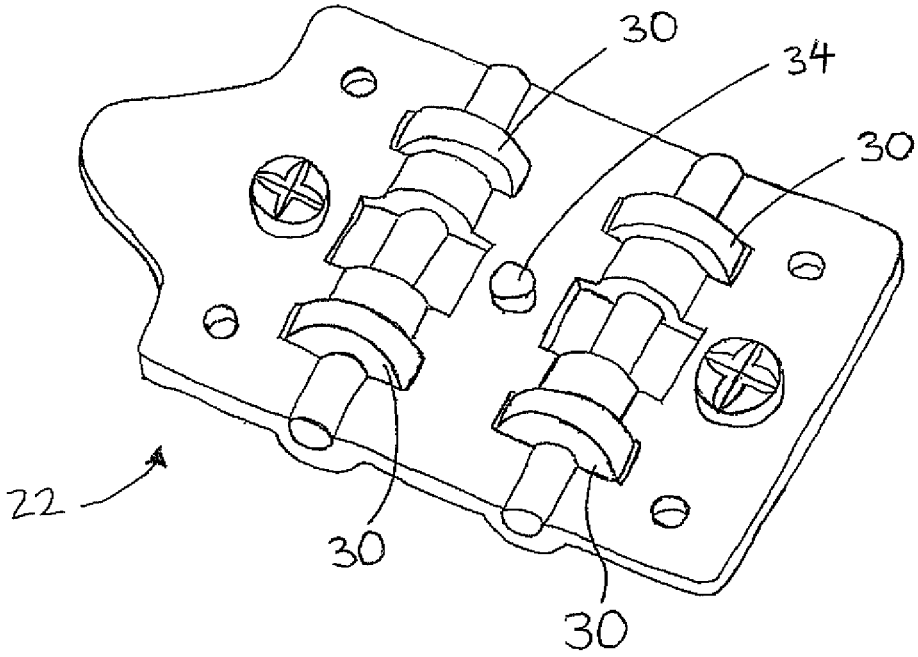
FIG. 6 is a bottom perspective view of the carriage.
Figure 7:
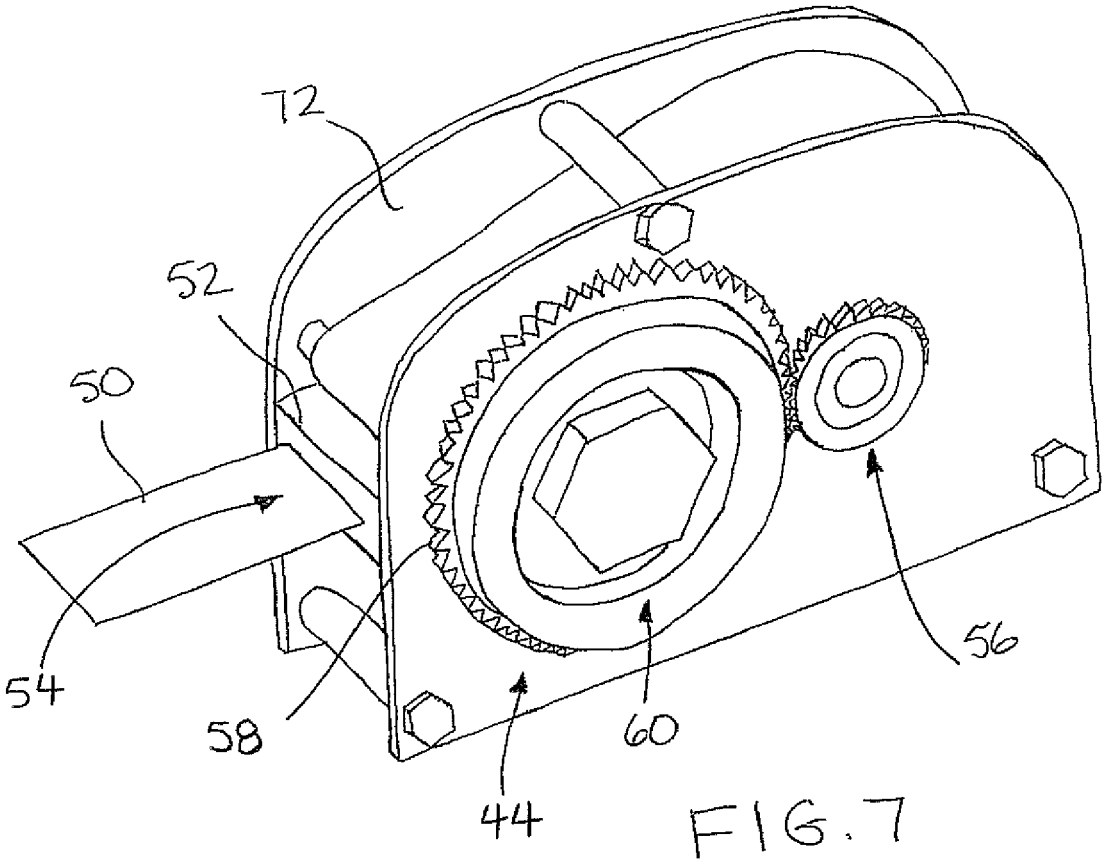
FIG. 7 is perspective view of one embodiment of the resistance and winding mechanism.
Figure 8:
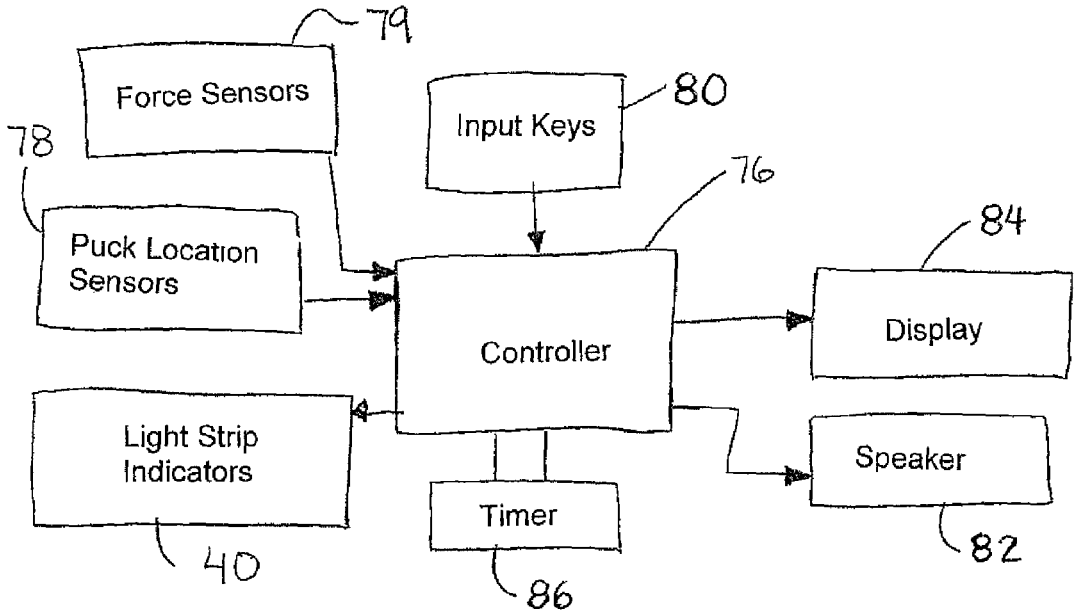
FIG. 8 is a schematic illustration of the operation of the controller.
Figure 9:
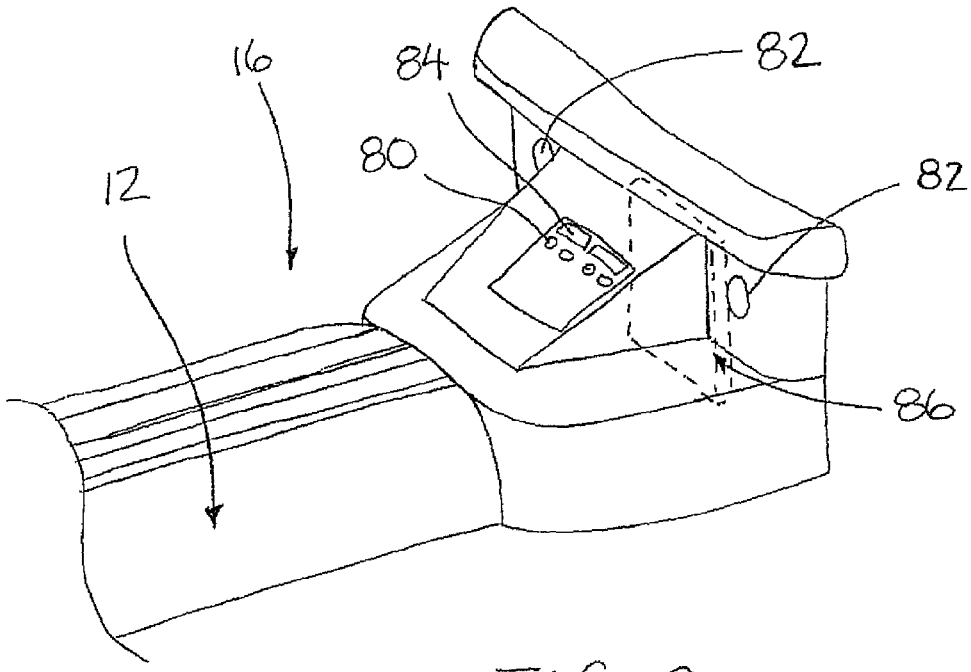
FIG. 9 is a perspective view of the controller housing.
Figure 13:
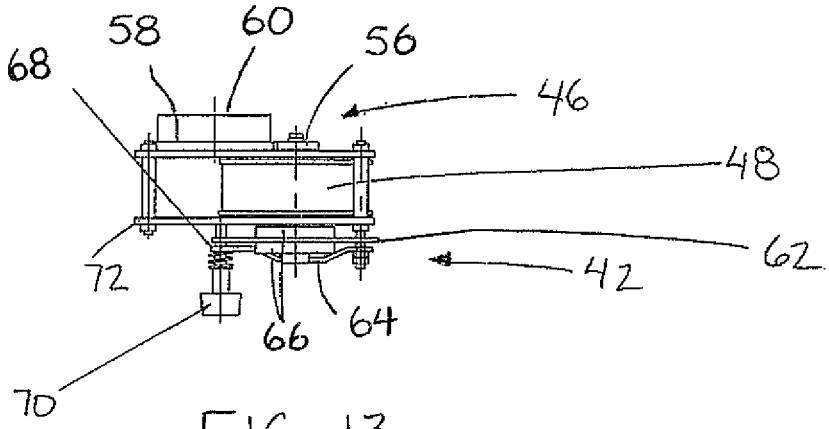
FIG. 13 is a top plan view of the spool shown connected to the resistance mechanism and the winding mechanism of FIG. 10.
Figure 10:
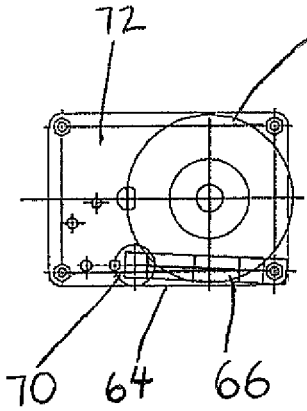
FIG. 10 is a side elevational view of the resistance mechanism acting on the spool according to a second embodiment.
Figure 11:
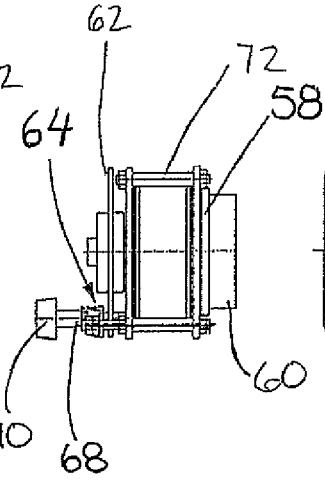
FIG. 11 is an end elevational view of the spool illustrating the resistance mechanism and the winding mechanism of FIG. 10.
Figure 12:
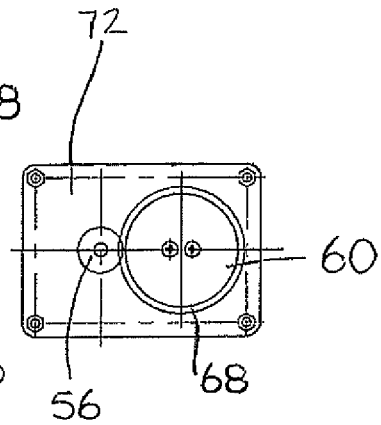
FIG. 12 is a side elevational view of the winding mechanism on the opposing side of the spool relative to FIG. 10.
Figure 14:
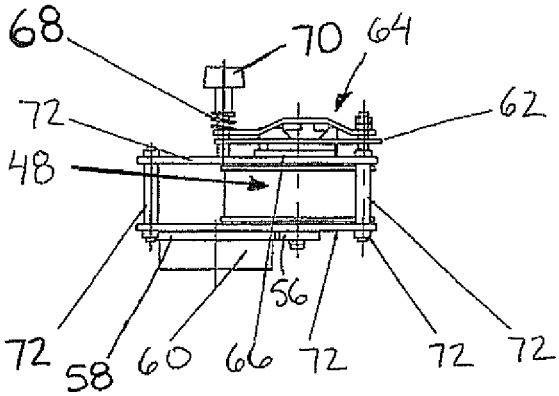
FIG. 14 is a bottom plan view of the spool connected to the resistance and winding mechanisms of FIG. 10.

Referring to the accompanying figures there is illustrated a hockey shooting training device generally indicated by reference numeral 10. The device 10 is particularly suited for training a user in shooting a hockey puck with a hockey stick. The device trains the user for proper technique as well as providing constant resistance against the shooting motion for strength training.

The device 10 comprises an elongate track 12 which extends in a longitudinal forward direction between a starting end 14 and a target end 16. The track 12 comprises an extruded member having a hollow core with several partitions therein so as to have a constant cross section along the length thereof. In the illustrated embodiment the track is extruded of a light weight metal.

The track 12 comprises a flat bottom to which is secured one or more flat gripping members 18 for gripping engagement on a horizontal supporting surface. A channel 20 is formed within the elongate track 12 to extend along the length of the track and to support a carriage 22 for rolling movement therein such that the carriage may be slid in the longitudinal direction along the length of the track in the longitudinal forward direction.

The channel 20 comprises a bottom wall 24 having a flat running surface at both opposed sides of the channel to extend in the longitudinal direction. A top wall 26 also defines a flat running surface along two sides of the channel which is parallel and spaced above the bottom wall to receive the carriage 22 therebetween. The top wall 26 comprises two flanges projecting inwardly towards one another from opposing sides of the channel at the top side of the track to define a slot 28 in the top wall between the flanges along the length of the track in the longitudinal forward direction.

The carriage 22 comprises a flat body supported for rolling movement on the top and bottom walls of the track by respective wheels 30. Four wheels are provided such that two pairs of wheels are provided laterally spaced apart from one another on opposing sides of the slot 28 and such that two pairs of the wheels are also spaced apart in the longitudinal forwarding direction relative to one another. The carriage body is closely received between opposing upright side walls of the channel to suitably locate the wheels on opposing sides of the carriage in longitudinal alignment with one another and the running surfaces of the top and bottom walls of the channel. Each of the wheels 30 comprises a rigid core with a peripheral surface of resilient rubber material thereon such that the resilient rubber surface of the wheels contacts the running surfaces of the channel to minimize noise as the carriage is displaced in the longitudinal direction along the track.

The carriage 22 comprises an engaging member 32 supported thereon in the form of a post 34 mounted centrally on the carriage body to be centered in the longitudinal direction between some of the wheels of the carriage and to also be centered in the lateral direction between some of the wheels of the carriage. The post 34 extends upwardly through the slot 28 in the top wall of the track from the carriage body received within the track to an upper body 36 supported above the track. The upper body 36 is suitably shaped and sized to correspond to a standard official hockey puck. The upper body 36 is coupled to the post 34 so as to be fully rotatable 360 degrees about the vertical axis of the post relative to the carriage. The upper body 36 is supported to lie substantially horizontally on the top side of the track spaced sufficiently thereabove so as not to interfere with the sliding movement of the carriage along the track.

An upper surface of the track includes a wear resistant strip 38 formed within each of the two flanges forming the top wall of the channel such that the strips 38 extend in the longitudinal direction parallel and spaced apart from one another on opposing sides of the slot with the upper body 36 of the carriage being centered therebetween. The strips 38 are received within respective grooves formed in the top wall but are arranged to extend upwardly beyond the upper surface of the track slightly such that a hockey stick engaged upon the top side of the track for alignment with the upper body 36 of the carriage is engaged upon the two wear strips 38. As the user performs a shooting action by displacing the upper body 36 along the track with the hockey stick, the stick rides along the strips 38 to prevent excessive wear to the surface of the track 12. The material forming the strips 38 is more durable and wear resistant than the material of the track. The strips 38 are positioned close enough together that the space between the strips is less than the overall width or diameter of the puck shaped upper body such that the puck shaped upper body overlaps both wear strip in the illustrated embodiment.

An indicator strip 40 is also provided in a top surface of each of the two flanges forming the top wall of the channel so that the two indicator strips 40 are parallel and spaced apart from one another on opposing sides of the slot to extend similarly in the longitudinal forward direction. Each indicator strip is located in the lateral direction between the slot and a respective one of the wear strips 38. Each indicator strip comprises a plurality of segments of lights arranged to be illuminated independently of one another in a sequence along the length of the strip in the longitudinal direction. Each strip is received within a respective groove formed in the top side of the track such that the strip is fully recessed into the top surface so that the indicator strip is protected from contact by a hockey stick and is similarly protected from contact by the puck shaped upper body of the carriage slidably displaced thereabove along the length of the track.

In use a user displaces the puck by engaging the blade of a hockey stick along the wear strips from a start position in which the carriage is located adjacent the starting end of the track and an end position in which the carriage is located adjacent the target end of the track. The movement from the start position to the end position is accomplished by the user against a force of resistance provided by a resistance mechanism 42 housed within a suitable housing 44 at the starting end of the track. A winding mechanism 46 is also received within the housing 44 and serves to return the carriage automatically from the end position back to the start position when a user releases the carriage and returns their hockey stick towards the starting end of the track.

In each instance a spool 48 is mounted within the housing 44 at the starting end of the track onto which a tether 50 is wound about a spool axis of the spool. The spool is supported for rotation about the spool axis which is oriented horizontally and perpendicularly to the longitudinal forward direction at the starting end of the track. A first end of the tether 50 is coupled to the spool body for winding onto the spool while the opposing second end of the tether is fixed onto the carriage body 22. The tether is wound onto the spool such that displacement of the carriage from the starting end to the target end causes the tether to be unwound from the tether while winding of the tether onto the spool in turn causes the carriage to be returned from the target end to the starting end of the track.

The tether comprises a flat band of flexible material having a width in the axial direction of the spool which spans substantially the full width of the spool. To ensure that the tether is evenly wound onto the spool, the tether is guided through a suitable guide block 52 at the starting end of the track which includes a slot 54 formed therein in alignment with the channel of the track which receives the carriage body therein to which the tether is coupled. The slot 54 in the guide block is suitably dimensioned to closely fit the tether therein for guiding the tether to be wound onto the spool. The tether is accordingly slidably received through the slot in the guide block between opposed ends of the tether attached to the spool and the carriage respectively.

The spool includes a driven gear 56 fixed onto one end thereof such that the gear is coaxial with the spool about the spool axis and is arranged for rotation with the spool. The driven gear 56 meshes with a drive gear 58 of the winding mechanism 46 in which the drive gear is rotatable about a winding axis which is parallel and spaced from the spool axis. The drive gear 58 has a diameter which is many times the diameter of the driven gear such that the drive gear has many more teeth than the driven gear. A suitable spring 60 is coupled to the drive gear 58 concentric about the winding axis and anchored to the housing so as to be arranged to bias rotation of the drive gear in a winding direction which in turn causes the driven gear and the spool coupled thereto to similarly be driven in the winding direction which corresponds to the tether being wound in the spool and the carriage being returned from the end position to the start position. The spring 60 applies a very minimal return force to the carriage which is much less than the resistance force of the resistance mechanism such that the returning force by the spring 60 is easily overcome by the user and the force of resistance is controlled independently of the winding mechanism by the resistance mechanism.

The resistance mechanism generally comprises a brake disc 62 which is coupled to rotate with the rotation of the spool. The brake disc comprises a generally flat disc arranged to be engaged by a brake member 64 comprising two braking elements 66 arranged to be clamped onto axially opposed faces of the brake disc 62. A screw member 68 is coupled to the elements 66 for tightening the clamping forces of the elements against opposing faces of the brake disc by rotating the screw member. The screw member is coupled to an adjustable knob 70 mounted on the exterior of the housing 44 for ready access by the user to select between anyone of a number of resistance settings by rotation of the knob. Each of the settings of the knob corresponds to one of a plurality of different frictional forces arranged to be applied to the spool by the resistance mechanism in which each of the forces comprises a constant force of resistance once selected.

In the illustrated embodiment of FIGS. 10 through 14, the brake disc 62 is mounted coaxially with the spool body about the spool axis for rotation together with the driven gears such that the brake disc and the driven gear are supported at axially opposed ends of the spool. A suitable frame 72 is provided comprising a pair of parallel plates mounted upright and spaced apart from one another between which the spool body is supported for rotation within the housing 44. The elements of the resistance mechanism and the winding mechanism are accordingly supported on the parallel plates forming the frame 72.

A controller 76 is provided at the target end of the track opposite the housing 44 supporting the resistance mechanism and the winding mechanism therein. The controller 76 comprises a processor mounted within a suitable housing at the target end of the track. The controller 76 receives inputs from a plurality of puck location sensors 78 at various positions along the track for sensing proximity of the upper body of the carriage, force sensors 79 for sensing the force applied by the user which urges the puck shaped body forwardly along the track, as well as a plurality of user input keys 80 supported on the controller housing at the target end of the track so as to be readily accessible by a hockey stick. The user keys 80 are used to select various functions of the controller.

The controller also communicates with various outputs including an audio speaker 82, a visual display 84, and the indicator strips 40 to prompt the user and indicate various information to the user during use. The indicator strips 40 in particular are intended to provide peripheral guidance to the user as the illuminated indicator strips permit the user to keep track of the linear displacement path of the puck shaped upper body of the carriage by peripheral vision while maintaining a forwardly directed focus for optimal techniques.

The controller operates the light strips by detecting the proximity of the carriage at various points along the length of the track such that the controller illuminates the segment of the indicator strips which are in proximity to the carriage. More particularly when the carriage is at the starting end of the track, none of the segments of the strips are illuminated, however as the carriage approaches and becomes adjacent each sequential segment, that segment becomes illuminated and remains illuminated after the carriage continues past towards the target end of the track. Upon reaching the target end and returning to the starting end, the controller turns all of the illumination of the indicators strips off again so as to sequentially illuminate the sections of the indicator strip upon further displacement of the carriage from the starting position to the end position. In the illustrated embodiment the indicator strips 40 preferably comprise a strip of a plurality of light emitting diodes in series with one another in the longitudinal direction of the track.

To use the device, the user typically initially sets the desired amount of constant frictional resistance to be applied by using the knob 70 on the exterior of the housing at the starting end of the device. The winding mechanism ensures that the carriage is positioned adjacent the starting end of the track. A power button is used to activate the controller and the user input keys 80 subsequently determine what mode or program a user desires to follow during training. Depending upon the mode selected, the controller provides visual and audio cues through the display and the speakers which indicate to the user when to start exercising.

The user typically positions the device against a wall or other fixed structure. The user then positions themselves so that their back foot is about three inches ahead of the puck shaped engaging body in the longitudinal direction of the track and approximately one foot away from the track in a lateral direction from the track depending upon the size of the user. The blade of the hockey stick is then placed behind the puck shaped body at the starting end of the track. A shooting motion will displace the puck shaped body along the track against the resistance provided by the resistance mechanism. After each displacement to the target end of the track, returning the stick to the starting end of the track allows the winding mechanism to return the puck shaped body to the starting end of the track.

The controller uses the puck sensors along the track to record the number of repetitions of the carriage displacement between opposing ends of the track as well as the speed of the displacement so that this recorded information can be displayed back to the user using the display. The controller also communicates with a timer 86 to display a duration of the training period. With each cycle of the puck shaped body from the starting end to the target end, the segments of the illuminated indicator strip are illuminated in sequence responsive to the puck shaped body of the carriage being in proximity thereto.

In one mode of operation, the controller is arranged to countdown from a selected duration and the user is prompted to complete as many repetitions as possible within the prescribed duration before the expiry of the time. At the end of the prescribed duration, the number of repetitions are displayed to the user so that the user can attempt to improve their performance in subsequent training periods.

In further mode of operation, a competition mode can be selected in which the results of a first user are recorded corresponding to the number of repetitions during a prescribed period of time and the results are maintained in a memory of the controller while a second user performs a similar exercise of completing as many repetitions as possible within a second prescribed duration which is equal to the first duration. The results of the second user are then compared to the results of the first user to determine a winner based upon the greatest number of repetitions completed within the prescribed duration.

For each training period, the controller provides cues to the user as to when the prescribed training period begins. During the prescribed duration of the training period, various encouraging phrases are played over the speakers to provide performance feedback or to encourage improved performance by the user. Upon completion of the prescribed duration, the controller provides further notification to the user which may include a whistle or further pre-recorded sounds including performance feedback or encouraging phrases.

The controller permits the counter which counts the number of repetitions of the displacement of the carriage between opposing ends to be reset at any time to zero by pressing a suitable one of the user keys. Furthermore the prescribed duration when in a countdown mode of operation can be adjustable in various prescribed increments. Other options include disabling the speakers so that only visual feedback is provided through the display if desired.

The controller also uses the force sensors 79 located on the upper body of the carriage or in communication with the resistance mechanism to sense the force being applied by the stick of the user against the puck shaped upper body to urge the body in the forward direction along the track from the starting end to the target end. The sensed force is recorded and displayed back to the user in a continuous real time manner or as an average upon completion of one or more repetitions of movement between starting and ending positions during a prescribed training period. The sensed force can also be used in combination with the recorded number of repetitions and the prescribed duration to calculate other information displayed to the user representing an overall amount of work performed by the user during a prescribed training period.

Figure 15:
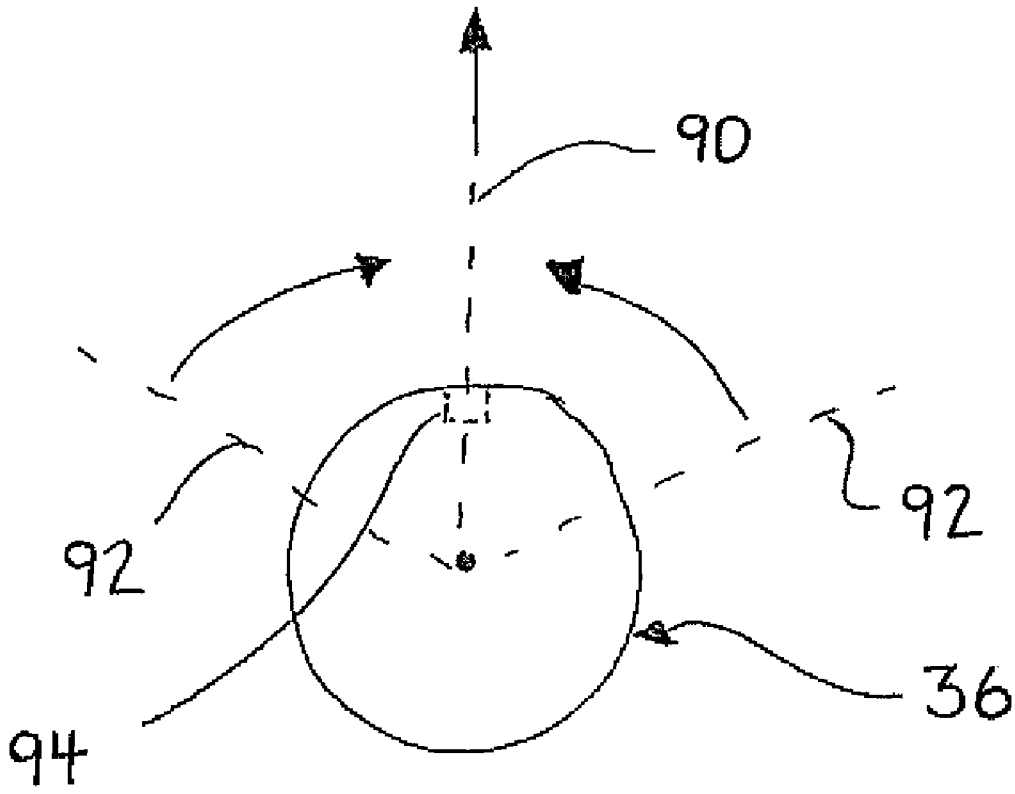
FIG. 15 is a top plan view of the engaging member according to a further embodiment of the training device.

Turning now to FIG. 15 according to a further embodiment of the invention, the puck shaped upper body 36 of the carriage may be supported such that the body remains rotatable about a vertical axis but is biased to a central position indicated by broken line 90 in FIG. 15. The body is rotatable from the central position 90 in either one of two directions of rotation about the vertical axis to two opposed angular offset positions indicated by broken lines 92. A biasing mechanism serves to urge the body to be rotated from either one of the angular offset positions 92 back to the central position 90.

A direction indicator 94 is provided in the upper body 36 of the carriage for rotation with the upper body about the vertical axis relative to the carriage and track. The direction indicator 94 comprises a light source which projects a beam of light radially outward from the vertical axis to project forwardly in the longitudinal direction of the track in the central position 90. The beam of light is accordingly projected generally horizontally at an inclination from the longitudinal direction in either of the two angular offset positions. When positioning the target against a wall, or other upright supporting surface, the indicator 94 projects the beam of light onto the upright supporting surface so that the direction of the puck shaped body can be readily indicated to the user of the device. As the user displaces the puck shaped body with their hockey stick from the starting end to the target end, engagement of the stick with the body permits some rotation of the body away from the central position towards one of the angular offset positions 92 which will be indicated to the user by displacement of the beam of light from a forward location to a laterally offset position relative to the track. The direction indicator 94 thus provides further guidance to the user to ensure that the user is following proper shooting technique.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A hockey shooting training device comprising:

an elongate track extending from a starting end to a target end;

a carriage supported on the track for sliding movement in a forward direction along the track between a start position adjacent the starting end and an end position adjacent the target end;

an engaging member coupled to the carriage for sliding movement therewith along the track, the engaging member extending upwardly above the track so as to be arranged to be engaged by a hockey stick of a user;

a spool supported for rotation about a spool axis which is fixed relative to the track;

a non-elastic tether having a first end wound onto the spool about the spool axis and a second end coupled to the carriage such that the tether is arranged to be unwound from the spool as the carriage is displaced from the start position to the end position;

a winding mechanism arranged to provide a biasing force to wind the tether onto the spool and return the carriage from the end position to the start position; and a resistance mechanism independent of the winding mechanism which is arranged to apply a constant frictional force independently of the biasing force of the winding mechanism to the spool which controllably resists rotation of the spool and unwinding of the tether from the spool as the carriage is displaced from the start position to the end position.

2. The device according to claim 1 wherein the constant friction force comprises a selected one of a plurality of different constant frictional forces arranged to be applied to the spool by the resistance mechanism.

3. The device according to claim 1 wherein the resistance mechanism comprises a brake disc coupled to the spool to rotate with the spool and a brake member arranged to apply the frictional force to the brake disc.

4. The device according to claim 3 wherein the brake member is arranged to clamp against axially opposed faces of the brake disc.

5. The device according to claim 3 further comprising a screw member arranged to urge the brake member against the brake disc, the frictional force being adjustable by rotating the screw member.

6. The device according to claim 1 wherein the winding mechanism comprises a driven gear coupled to the spool for rotation therewith about the spool axis, a drive gear in meshing engagement with the driven gear and a biasing mechanism coupled to the drive gear so as to be arranged to bias the drive gear in a winding direction corresponding to rotation of the spool member to wind the tether onto the spool and to return the carriage from the end position to the start position.

7. The device according to claim 6 wherein the driven gear comprises a smaller gear than the drive gear.

8. The device according to claim 1 wherein the tether comprises a flat belt arranged to span a width of the spool in an axial direction between opposed ends of the spool.

9. The device according to claim 8 further comprising a guide member supported at the starting end of the track including an elongate slot formed therein having dimension arranged to closely receive the tether therethrough between the first and second ends of the tether.

10. The device according to claim 1 further comprising an indicator which is elongate and which extends along the track in the forward direction, the indicator being arranged to be illuminated.

11. The device according to claim 10 wherein the indicator comprises a plurality of segments in series with one another in the forward direction and a controller arranged to illuminate the segments in sequence upon displacement of the carriage member from the start position to the end position.

12. The device according to claim 1 wherein the track comprises a channel having a bottom wall and a top wall which are spaced apart from one another along a length of the track and a slot in the top wall extending the forward direction along the length of the track and the carriage comprises a plurality of wheels spaced apart in the forward direction adjacent opposing ends of the carriage and spaced apart in a lateral direction on opposing sides of the slot so as to be arranged for rolling movement along the channel of the track, the wheels having a peripheral surface which comprises a resilient material.

13. The device according to claim 1 wherein the engaging member comprises a puck which is coupled to the carriage for full rotation relative to the carriage about an upright axis.

14. The device according to claim 1 wherein the engaging member is coupled to the carriage for rotation relative to the carriage about an upright axis in two opposing directions from a central position to a respective pair of angularly offset positions and wherein there is provided a biasing mechanism arranged to bias the engaging member from both of the angularly offset positions to the central position and a direction indicator arranged to indicate an angular offset of the engaging member from the central position about the upright axis.

15. The device according to claim 14 wherein the direction indicator comprises a light source on the engaging member which is arranged to project a beam of light in the forward direction in the central position of the engaging member, the light source being rotatable about the upright axis with the engaging member.

16. A hockey shooting training device comprising:

an elongate track extending from a starting end to a target end;

a carriage supported on the track for sliding movement in a forward direction along the track between a start position adjacent the starting end and an end position adjacent the target end;

an engaging member coupled to the carriage for sliding movement therewith along the track, the engaging member extending upwardly above the track so as to be arranged to be engaged by a hockey stick of a user;

a resistance mechanism arranged to apply a resistive force which controllably resists displacement of the carriage from the start position to the end position;

an indicator which is elongate and which extends along the track in the forward direction, the indicator being arranged to be illuminated and the indicator comprising a plurality of segments in series with one another in the forward direction; and a controller arranged to illuminate the segments in sequence upon displacement of the carriage member from the start position to the end position.

17. The device according to claim 16 wherein the controller is arranged to illuminate each segment of the indicator independently of the other segments responsive to proximity of the carriage to the segment.

18. A hockey shooting training device comprising:

an elongate track extending from a starting end to a target end;

a carriage supported on the track for sliding movement in a forward direction along the track between a start position adjacent the starting end and an end position adjacent the target end;

an engaging member coupled to the carriage for sliding movement therewith along the track, the engaging member extending upwardly above the track so as to be arranged to be engaged by a hockey stick of a user;

the engaging member being coupled to the carriage for rotation relative to the carriage about an upright axis in two opposing directions from a central position to a respective pair of angularly offset positions;

a biasing mechanism arranged to bias the engaging member from both of the angularly offset positions to the central position;

a resistance mechanism arranged to apply a resistive force which controllably resists displacement of the carriage from the start position to the end position; and a direction indicator arranged to indicate a direction of angular offset of the engaging member from the central position about the upright axis towards a respective one of the angular offset positions of the engaging member.

19. The device according to claim 18 wherein the direction indicator comprises a light source on the engaging member which is arranged to project a beam of light in the forward direction in the central position of the engaging member, the light source being rotatable about the upright axis with the engaging member.

* * * * *